US006095073A

United States Patent [19]

Burkett

[11] Patent Number: 6,095,073

[45] Date of Patent: Aug. 1, 2000

[54] MULTIHULL BOAT

[76] Inventor: Jerry Douglas Burkett, 211 Eldorado Dr., Richmond, Va. 23229

[21] Appl. No.: 09/128,028

[22] Filed: Aug. 3, 1998

Related U.S. Application Data

[60] Provisional application No. 60/005,120, Aug. 4, 1997.

[51] Int. Cl.[7] ..... B63B 1/00

[52] U.S. Cl. ..... 114/61.1; 114/61.2

[58] Field of Search ..... 114/61.1, 123, 114/61.2, 343, 364

[56] References Cited

U.S. PATENT DOCUMENTS

| | | | |
|---|---|---|---|
| Re. 33,359 | 10/1990 | Lang . | |
| D. 278,138 | 3/1985 | Enfedaque . | |
| D. 370,003 | 5/1996 | Kieronski . | |
| 3,937,164 | 2/1976 | Austin . | |
| 3,961,590 | 6/1976 | Kefalas . | |
| 4,376,416 | 3/1983 | Carver . | |
| 4,584,959 | 4/1986 | Allison . | |
| 4,854,256 | 8/1989 | Hayashi | 114/61.1 |
| 4,854,257 | 8/1989 | Grayson . | |
| 5,038,696 | 8/1991 | Athanasiou et al. . | |
| 5,379,710 | 1/1995 | Parnigoni . | |
| 5,458,078 | 10/1995 | Perette . | |
| 5,526,762 | 6/1996 | Kiley . | |
| 5,529,008 | 6/1996 | Craig . | |
| 5,595,132 | 1/1997 | Bystedt et al. | 114/61.1 |
| 5,619,944 | 4/1997 | Baker | 114/61.1 |

*Primary Examiner*—Stephen Avila
*Attorney, Agent, or Firm*—John F. C. Glenn

[57] ABSTRACT

A boat that can be rowed, sailed and motor driven, and has a pair of parallel elongated pontoons and a normally above-water boxlike structure which serves to connect the pontoons, to provide a cockpit for the crew, and to provide a third hull for supplemental flotation when needed. A pair of parallel structural panels form opposite sidewalls of the cockpit and each extends down through the middle of the adjacent pontoon to its keel. The cockpit deck structure connects the panels and covers the part of each pontoon between the panels. The part of each pontoon on the other side of the adjacent panel forms a ledge along the outer side of the boat which is helpful in climbing out of the water into the boat.

12 Claims, 3 Drawing Sheets

MULTIHULL BOAT

FIELD OF THE INVENTION

The benefit of U.S. Provisional Pat. application Ser. No. 60/055,120 filed Aug. 4, 1997 by Jerry D. Burkett is claimed under Title 35 U.S. Code 119(*e*) for his application for the present Pat.

The invention relates to boats of the catamaran type, which have two hulls for floatation, but includes a third hull mounted on and between the first two for supplemental flotation when needed. Boats of this invention are for rowing, sailing, and outboard motor boating, and for use as a dingy for towing behind large boats.

BACKGROUND OF THE INVENTION

Catamarans have been used for centuries in the form of two hulls connected in parallel relation, for commercial and exploratory purposes. In more recent times recreation has become a widely enjoyed possibility and the speed potentials of catamarans have become appreciated and exploited in sailboats and powerboats. In the case of small boats such as dinghies for one person to operate and one or two others along for the ride there is a wide choice of monohulls for every purse and fancy, but small catamarans, such as the very successful Hobie Cat sailboats, while performing well for their design purpose of racing, are ill suited for being rowed or powered by motor, or for relaxed activities such as fishing. So an unfulfilled demand has built up for a boat hull which has the speed and stability advantages of a catamaran, which is compact and inherently strong and practical to build, which can perform well when under sail, when towed, when powered by motor, and when towed behind a larger boat, and has floatation and reboarding abilities that improve stability and help in getting aboard swimmers or those in trouble in the water.

SUMMARY OF THE INVENTION

The present invention provides a catamaran boat which goes far to satisfy the requirements stated above. The boat has twin pontoon hulls which support the rest of the boat above the waterline when the boat is afloat on quiet water, and has a superstructure with the combined functions of rigidly connecting the twin hulls in spaced-apart parallel relation, of providing a third hull which is above water except when it begins to float on water rising above the twin hulls, and of providing an open cockpit for occupation by the person operating the boat and for some additional load of persons or baggage on board the boat. The boat has means for mounting a pair of oarlocks for oars for rowing, for mounting a mast and sail, and for pivotally supporting rudder and tiller on a rear transom for sailing, and for mounting a motor on the transom for motor boating.

The structure of the boat includes a pair of spaced parallel panels which extend down to the keels of the pontoons and up to form the side walls of the third hull of the boat, thereby establishing a foundation for building a rigid structure for the whole boat. The twin hulls are each symmetrical on opposite sides of the respective panels except that the top of each twin hull merges into the connecting structure on one side of the adjacent panel and on the other side of the panel forms a ledge extending outwardly from the bottom of the adjacent side wall of the cockpit. The ledge is helpful to a person climbing out of the water and over the side wall into the cockpit.

Other advantages, objects and details of the invention will become apparent as the following detailed disclosure proceeds.

DESCRIPTION OF THE INVENTION

Figure 1:
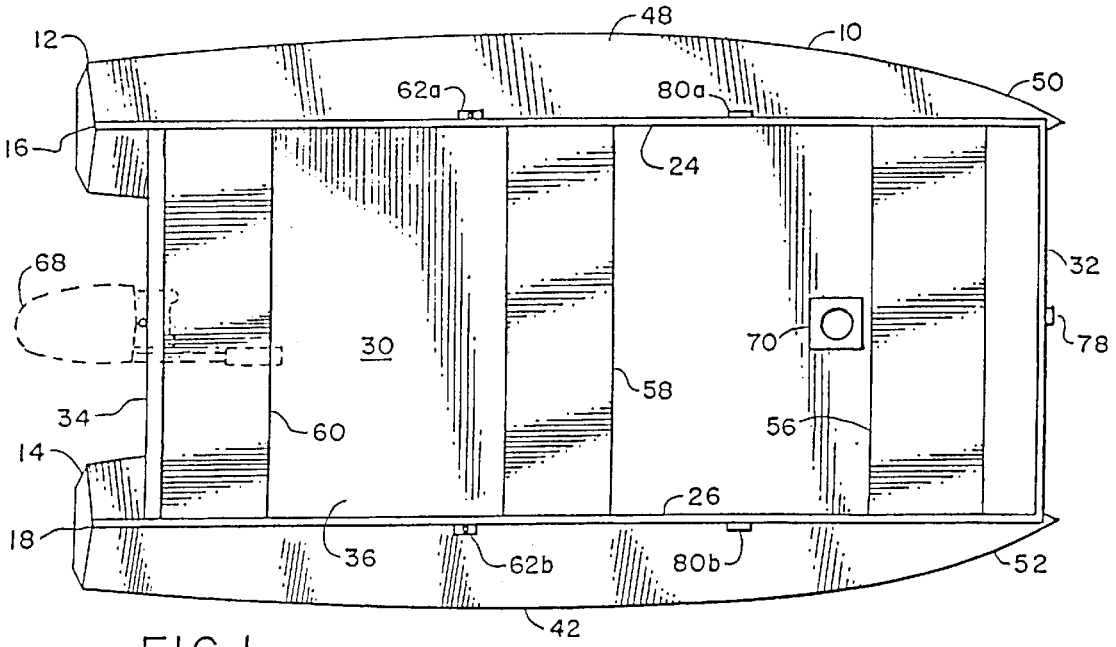
FIG. 1 shows a plan view from above of a boat embodying the invention, with an outboard motor shown in phantom lines on the transom.

The boat 10 shown in the drawings is a catamaran having spaced parallel twin pontoons 12 and 14 integral with a connecting structure which is supported above water by the pontoons when afloat in quiet water.

The connecting structure extends between a pair of parallel vertical structural panels 16 and 18 having lower portions which extend downwardly to the keels 20 and 22 of the respective pontoons 12 and 14, and upper portions which form side walls 24 and 26 for a box-like hull 23 which is a component of the connecting structure and functions as a boat hull to float on water rising over the pontoons due to waves or an unbalanced load on the boat. The box-like hull 28 also provides a cockpit for accommodating persons and baggage on the boat. It is completed by a forward transverse bow wall 32 secured by water-tight connections along its opposite sides to forward portions of sidewalls 24 and 26, by a transverse transom 34 secured by water-tight connections along its opposite sides to rear portions of side walls 24 and 26, and by a generally horizontal deck structure 36 extending across the area surrounded by walls 24, 26, 32 and 34, which extend up from the deck structure and have an integral water-tight connection with it. Water collecting in the cockpit 30, which is open above, may be drained out through a opening 38 through transom 24. Parallel cross beams 40 extend through deck structure 36 and bow wall 32 between panels 16 and 18 and are secured at their opposite ends to the panels in order to reinforce the deck and other structure of the boat.

Bow wall 32 leans forward over most of the lengths of the forward ends of pontoons 12 and 14 beyond the juncture of the upper surface of deck structure 36 with the rear surface of bow wall 32. Bow wall 32 has cross beams 40 like those of deck structure 36 and amounts to a forward extension of deck structure 36. However, the upper and lower surfaces of deck structure 36 extend forward from transom 34 generally horizontally until merging with bow wall 32. Then the corresponding surfaces of bow wall 32 continue in an upward curve which presents an approximately cylindrical convex surface to a wave met by the outer surface of the lower portion of bow wall 32. The curve continues up and forward in a flatter convex curve in the upper portion of bow wall 34.

Figure 5:
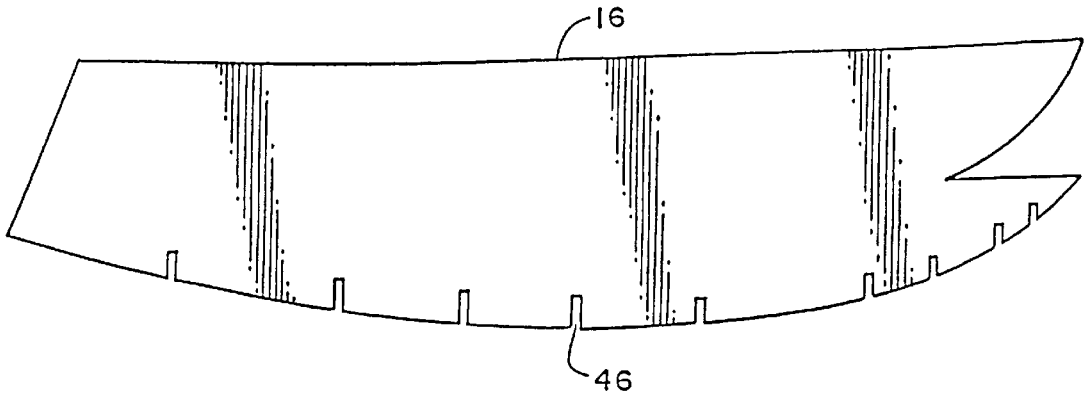
FIG. 5 shows a side view of one of the two parallel vertical panels shown on opposite sides of the boat in FIGS. 1–3.
Figure 6:
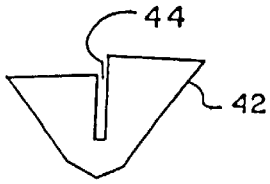
FIG. 6 shows a a view of a bulkhead of one of the pontoons of the boat shown in FIGS. 1–3.
Figure 7:
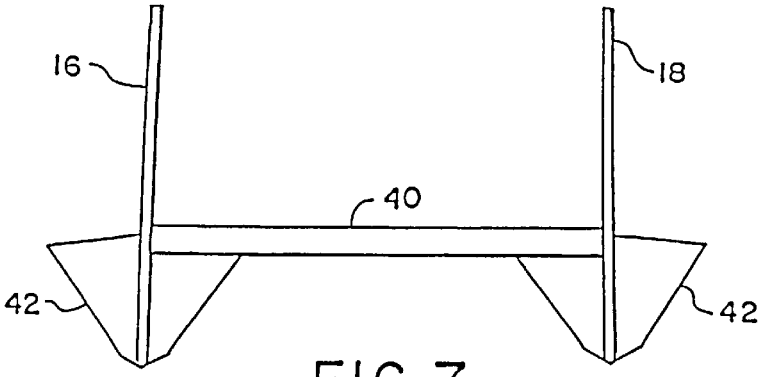
FIG. 7 shows an end view of two parallel panels corresponding to the panel shown in FIG. 5, with a connecting cross beam and two bulkheads corresponding to the one shown in FIG. 6.

The pontoons 12 and 14 are of the same size and shape and are symmetrical on opposite sides of the respective panels 16 and 18 except that each pontoon is a mirror image rather than a direct image of the other and except where the deck structure covers one side of each pontoon. Each pontoon is given its cross-sectional shape by a series of transverse bulkheads 42 of progressively varying shapes, one of which shape is shown in FIGS. 5 and 6. Each has a notch 44 at the top to slide past one of a series of notches 46 spaced along the bottom of the respective panels 16 and 18 in order to position each bulkhead on one of the panels preliminary to securing it to the panel. Each bulkhead is symmetrical on opposite sides of one of the panels 16 and 18 except where its top is shaped to fit under the deck structure 34 extending over one side of the pontoon in which the bulkhead is mounted, and to fit under and support an upwardly facing ledge-like surface 48 extending along the top of the other side of the pontoon. The surface 48 intersects and extends outwardly from the adjacent one of the cockpit side walls 24 and 26. The surface 48 on each pontoon is helpful in climbing up to the pontoon and over the adjacent sidewall to enter the cockpit of the boat.

Figure 2:
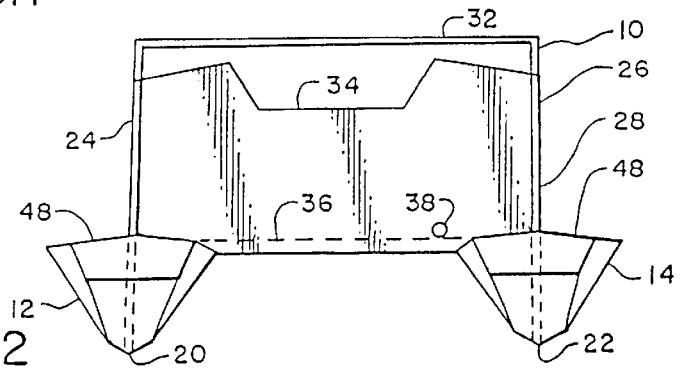
FIG. 2 shows a rear elevation of the boat of FIG. 1.
Figure 3:
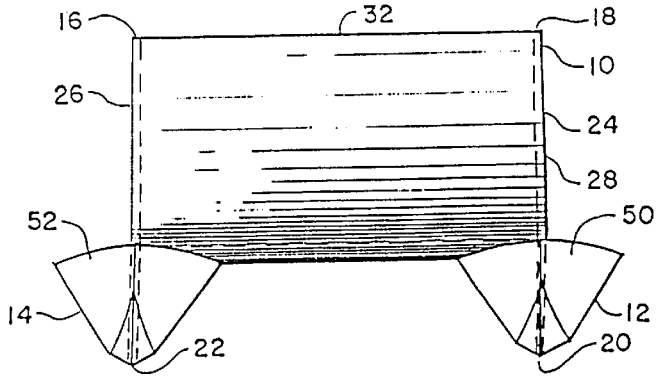
FIG. 3 shows a front end view of the boat of FIG. 1.
Figure 4:
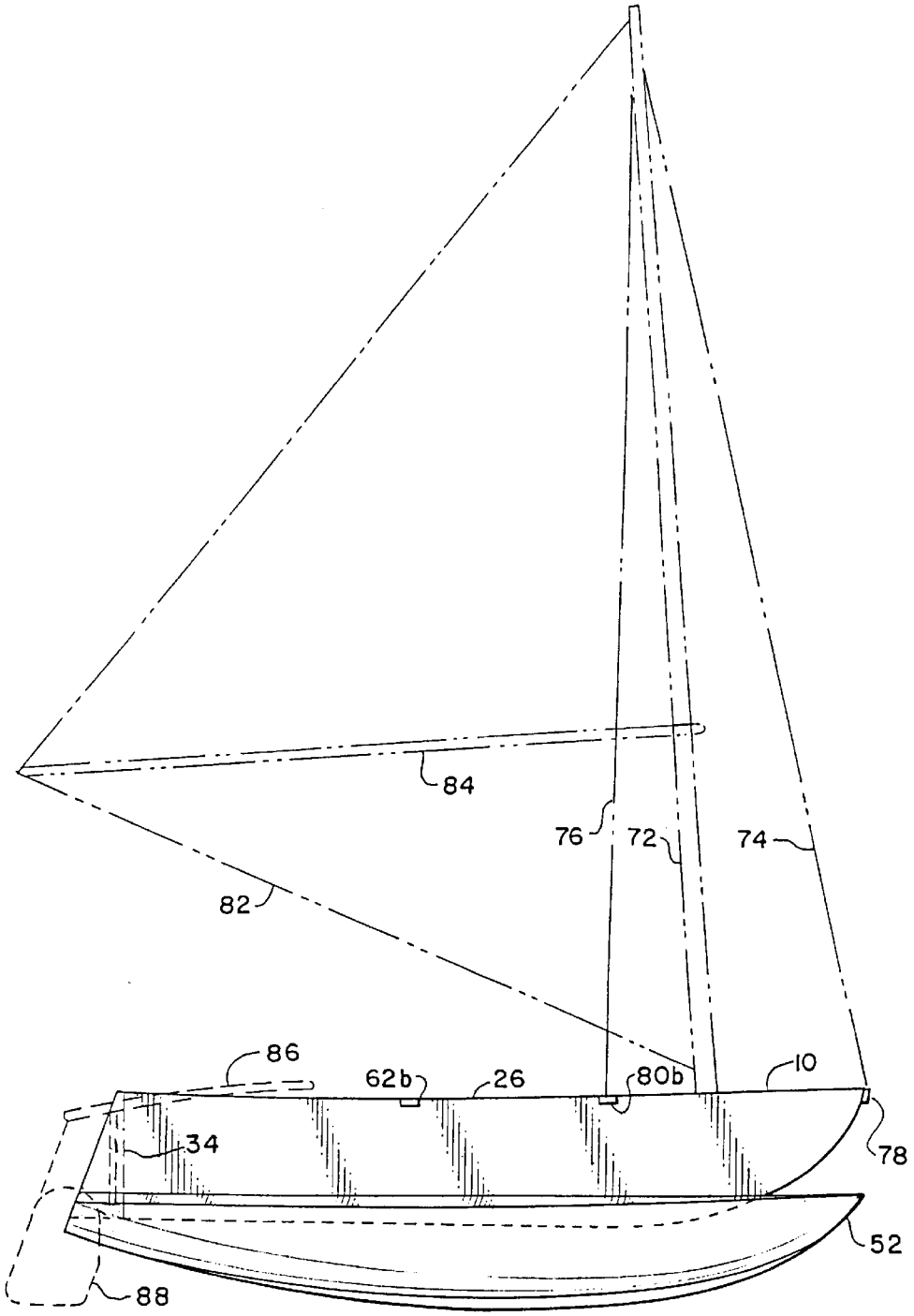
FIG. 4 shows a side view in the boat of FIGS. 1–3, in reduced scale, with a mast, sail, rudder and tiller shown in phantom lines.

The downwardly facing surfaces of the forward and middle pontoons form a wide angle V extending upwardly along both sides of the keel and then upwardly at a narrower angle of the V of almost 90° on both sides up to the top of each pontoon. The V angles begin to flatten about two-thirds of the way back from the bows 50 and 52 of the pontoons until the final bulkhead capping the aft end of each pontoon is entirely flat across its bottom surface 51 between its sides (FIG. 2). This improves the planing ability of the pontoons for greater speed, especially when motor powered.

Lengths of stiff but flexible sheet material are mounted over and secured to bulkheads and are covered with resin impregnated fiberglass to provide the outer structure and skin of the pontoons. The superstructure may be similarly glass coated. Rigid foam polymer is preferably used to fill the pontoons and the spaces in the deck and bow structure between the cross beams 40.

The cockpit 30 has a forward seat 56, a middle seat 58 and a rear seat 60. A pair of fittings 62*a* and -*b* are mounted on top of side walls 24 and 26 and have sockets in them to receive stems extending down from removable oarlocks. The fittings 62*a* and -*b* are far enough aft of seat 58 to enable a person sitting on seat 58 and facing transom 34 to pull on a pair of oars to row the boat forward (with the bow leading). An outboard motor 68 may be removably mounted on transom 34 where the transom is relieved to receive a motor, and where a person sitting on rear seat 60 may operate the motor.

The boat 10 is suitable for sailing by use of fore-and-aft rigs of various known types. For example, a fitting 70 is mounted on deck structure 36 next to the rear side of the middle of the forward seat 56 and has an opening in it for stepping the lower end of a mast 72. The upper end of the mast is secured to the upper ends of a forestay 74 and a pair of sidestays 76*a* and -*b*. A fitting 78 secured to the middle of the top of bow wall 32 connects with the lower ends of forestay 74, and a pair of fittings 80*a* and -*b* secured to the tops of the respective sidewalls 24 and 26 aft of mast 50 connect with the lower ends of the respective sidestays 76*a* and -*b*, to hold the mast up in its desired position until the connections to the fittings 78 and 80*a* and -*b* are disconnected and the mast is removed. One side of a triangular sail 82 is held by and slidable along a grooved track formed in or attached to the mast, and is raised and held up by a halyard attached to the top of the sail and extending around a roller at the top of the mast. A corner of the sail remote from the mast is attached to the ends of a split boom 84 which extends around the mast (where it may be connected to the mast to swing about the mast at a controlled level) and along both ends of the sail to a corner ot the sail remote from the mast, where the boom ends are attached to the corner. A person sitting on the rear seat 60 may sail the boat by holding in one hand a line from ends of the boom attached to the sail corner, and in the other hand holding a tiller 86 extending into cockpit 30 from a rudder 88 extending aft from transom 34 and turning on a mounting removably attached to the relieved middle portion of the transom. The rudder attachment preferably has conventional means for allowing the rudder to swing up when hitting an underwater obstacle in shallow water. The pontoon keels 20 and 22 are deep enough in the water to resist side slippage when under sail.

While present preferred embodiments and practices of the invention have been illustrated and described the invention may be otherwise embodied and practiced within the scope of the following claims.

I claim:

1. A boat comprising a pair of pontoons and a structure extending between and connecting the pontoons, the pontoons when afloat on quiet water being capable of supporting the boat with the part of said structure between the pontoons above and spaced from the water, and said connecting structure being also capable of serving as a third hull to provide additional floatation when water between the pontoons rises to reach the part of said structure between the pontoons, said structure comprising a pair of spaced side walls extending upwardly from the respective pontoons along most of their respective lengths, a forward wall and an aft wall extending transversely between and upwardly from the pontoons, and a bottom wall intersecting the pontoons and said forward, side and aft walls and closing the area bounded by the intersections of the bottom wall with the other walls to form said third hull.

2. A boat according to claim 1 in which the part of the forward wall between its intersections with the pontoons presents a convex curved forward surface across its width between the pontoons, and the part of the forward wall above the pontoons slants forward and extends about as far forward as the pontoons.

3. A boat according to claim 2 in which the aft wall is at substantially right angles to the side walls where it intersects them.

4. A boat according to claim 1 in which the side walls lie in parallel planes which substantially bisect the respective pontoons lengthwise along the middle of the width of each pontoon between its sides.

5. A boat according to claim 1, in which each pontoon has a V-shaped bottom with the apex of the V pointed downward and extending most of the length of the pontoon between its ends; in which the sidewalls substantially lie in parallel planes which respectively pass through the length of said bottom apex of each pontoon; in which the sidewalls substantially bisect the respective pontoons through the middle of the width of each pontoon between its sides, along most of its length; and in which the part of each sidewall which bisects a pontoon extends down through the pontoon to adjacent said apex at the bottom of the pontoon.

6. A boat according to claim 4 in which each pontoon comprises a top wall extending outwardly from the side of the adjacent side wall which faces away from the other pontoon, the top of the adjacent sidewall being within the reach of a person climbing onto the boat out of the water next to the side of the boat furthest from the other pontoon.

7. A boat according to claim 4 in which the side walls lie in parallel planes perpendicular to the bottom wall of the connecting structure between the pontoons.

8. A boat according to claim 7 in which the bottom wall is substantially rectangular around its periphery, and the forward and aft walls connect with eachother and with the periphery of the bottom wall to form above the bottom wall a substantially watertight space capable of supplementing the bouyancy of the pontoons.

9. A boat according to claim 1 in which each pontoon comprises a lower outer surface for contact with water on which the pontoon may ride, said outer surface being substantially downwardly pointing V-shaped in cross-section along most of the length of the pontoon but having a widening of the V angle in the aft portion of the pontoon until the V flattens to a substantially straight line at the aft end of the pontoon.

10. A boat according to claim 1 comprising means to mount an oarlock on each sidewall, a seat positioned over the bottom wall for a person using oarlocks so mounted to row the boat, means on the bottom wall for stepping a mast for a sail, and means for supporting an outboard motor mount on the aft wall.

11. A boat according to claim 1 in which said connecting structure comprises a deck for receiving the operator of the boat, positioned close to and overlying said bottom wall.

12. A boat comprising a pair of parallel elongated pontoons and a structure extending between and connecting the pontoons, the pontoons when afloat on quiet water being capable of supporting the boat with the part of said structure between the pontoons above and spaced from the water, the bottom of each pontoon having a downwardly projecting V shape along most of the length of the pontoon between its ends, and said structure comprising a forward wall and an aft wall extending transversely between the pontoons, a pair of sidewalls projecting upwardly along most of the length of the respective pontoons and extending between the forward and aft walls and between the sidewalls and pontoons, and a deck closely overlying the bottom wall, said side walls lying respectively in a pair of parallel planes which substantially bisect the pontoons from end to end along the middle portion of each pontoon between its sides and along the apex of the V-shaped portion of the bottom of each pontoon, and each side wall extending down into the adjacent pontoon into the inside of the V-shaped portion of the pontoon.

* * * * *